US008784587B2

(12) United States Patent
Lindgren et al.

(10) Patent No.: US 8,784,587 B2
(45) Date of Patent: Jul. 22, 2014

(54) FIBRE BASED PANELS WITH A DECORATIVE WEAR RESISTANCE SURFACE

(75) Inventors: Kent Lindgren, Perstorp (SE); Jan Jacobsson, Landskrona (SE); Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 28 days.

(21) Appl. No.: 12/976,478

(22) Filed: Dec. 22, 2010

(65) Prior Publication Data

US 2011/0189448 A1 Aug. 4, 2011

Related U.S. Application Data

(60) Provisional application No. 61/295,350, filed on Jan. 15, 2010.

(30) Foreign Application Priority Data

Jan. 15, 2010 (SE) ..... 10500387

(51) Int. Cl.
*E04B 2/00* (2006.01)
*E04F 13/00* (2006.01)

(52) U.S. Cl.
USPC ..... 156/71; 156/63; 156/279; 156/283; 156/296; 156/297; 156/307.3; 156/307.7; 264/109; 264/112; 264/113; 264/118; 264/119; 264/123; 264/125; 264/245; 52/309.1; 52/309.3; 52/309.15

(58) Field of Classification Search
USPC ..... 427/195, 198, 201, 202, 203, 260, 277, 427/356, 189; 428/103, 104; 156/279, 296, 156/297, 63, 71, 283, 298, 307.1, 307.3, 156/307.7, 308.2; 52/309.1, 309.3, 309.15; 264/109, 112, 113, 118, 119, 123, 125, 264/245
See application file for complete search history.

(56) References Cited

U.S. PATENT DOCUMENTS

| | | | |
|---|---|---|---|
| 2,587,064 | A | 2/1952 | Rapson |
| 2,962,081 | A | 11/1960 | Dobry et al. |
| 3,032,820 | A | 5/1962 | Johnson |

(Continued)

FOREIGN PATENT DOCUMENTS

| | | |
|---|---|---|
| AU | 80284/75 | 6/1975 |
| CA | 2 557 096 A1 | 7/2005 |

(Continued)

OTHER PUBLICATIONS

U.S. Appl. No. 13/444,604, Ziegler et al.

(Continued)

*Primary Examiner* — John Goff
*Assistant Examiner* — Hannuri L Kwon
(74) *Attorney, Agent, or Firm* — Buchanan Ingersoll & Rooney P.C.

(57) ABSTRACT

Building panels and a method to produce such panels including a solid decorative surface having a decorative wear layer including fibers, binders, color substance and wear resistant particles. A method of manufacturing a building panel having a decorative surface connected to a core wherein the surface has at least two homogenous layers, a lower sub layer and an upper decorative layer, the upper decorative layer including fibers, a first color substance a binder and wear resistant particles, the lower sub layer including fibers, a second color substance, and a binder, whereby the method including the steps of applying the layers comprising a mix of fibers, binder, wear resistant particles and color substance on a core wherein the layers comprise different colors, displacing particles from their original position such that particles from the sub layer are visible on the decorative surface, and curing the layers by providing heat and pressure.

16 Claims, 3 Drawing Sheets

(56) References Cited

U.S. PATENT DOCUMENTS

| | | | | |
|---|---|---|---|---|
| 3,135,643 | A | 6/1964 | Michl | |
| 3,308,013 | A | 3/1967 | Bryant | |
| 3,325,302 | A | 6/1967 | Hosfeld | |
| 3,342,621 | A | 9/1967 | Point et al. | |
| 3,345,234 | A | 10/1967 | Jecker et al. | |
| 3,426,730 | A | 2/1969 | Lawson et al. | |
| 3,463,653 | A * | 8/1969 | Letter | 427/272 |
| 3,486,484 | A | 12/1969 | Bullough | |
| 3,540,978 | A | 11/1970 | Ames | |
| 3,673,020 | A | 6/1972 | De Jaeger | |
| 3,846,219 | A | 11/1974 | Kunz | |
| 3,880,687 | A | 4/1975 | Elmendorf | |
| 3,897,185 | A | 7/1975 | Beyer | |
| 3,897,588 | A | 7/1975 | Nohtomi | |
| 3,914,359 | A | 10/1975 | Bevan | |
| 3,961,108 | A * | 6/1976 | Rosner et al. | 427/275 |
| 4,052,739 | A * | 10/1977 | Wada et al. | 283/75 |
| 4,093,766 | A * | 6/1978 | Scher et al. | 428/165 |
| 4,131,705 | A | 12/1978 | Kubinsky | |
| 4,313,857 | A | 2/1982 | Blount | |
| 4,337,290 | A | 6/1982 | Kelly et al. | |
| 4,430,375 | A | 2/1984 | Scher et al. | |
| 4,474,920 | A | 10/1984 | Kyminas | |
| 5,034,272 | A | 7/1991 | Lindgren et al. | |
| 5,246,765 | A | 9/1993 | Lussi et al. | |
| 5,258,216 | A | 11/1993 | von Bonin et al. | |
| 5,422,170 | A | 6/1995 | Iwata et al. | |
| 5,543,193 | A | 8/1996 | Tesch | |
| 5,569,424 | A | 10/1996 | Amour | |
| 5,601,930 | A | 2/1997 | Mehta et al. | |
| 5,604,025 | A | 2/1997 | Tesch | |
| 5,609,966 | A | 3/1997 | Perrin et al. | |
| 5,855,832 | A | 1/1999 | Clausi | |
| 5,925,296 | A | 7/1999 | Leese | |
| 5,942,072 | A * | 8/1999 | McKinnon | 156/247 |
| 6,103,377 | A | 8/2000 | Clausi | |
| 6,238,750 | B1 | 5/2001 | Correll et al. | |
| 6,468,645 | B1 | 10/2002 | Clausi | |
| 6,537,610 | B1 | 3/2003 | Springer et al. | |
| 6,773,799 | B1 * | 8/2004 | Persson et al. | 428/323 |
| 6,803,110 | B2 | 10/2004 | Drees et al. | |
| 6,926,954 | B2 | 8/2005 | Schuren et al. | |
| 6,991,830 | B1 | 1/2006 | Hansson et al. | |
| 7,022,756 | B2 | 4/2006 | Singer | |
| 7,485,693 | B2 | 2/2009 | Matsuda et al. | |
| 7,811,489 | B2 | 10/2010 | Pervan | |
| 8,349,234 | B2 | 1/2013 | Ziegler et al. | |
| 8,349,235 | B2 | 1/2013 | Pervan et al. | |
| 8,419,877 | B2 | 4/2013 | Pervan et al. | |
| 8,431,054 | B2 | 4/2013 | Pervan et al. | |
| 8,480,841 | B2 | 7/2013 | Pervan et al. | |
| 8,481,111 | B2 | 7/2013 | Ziegler et al. | |
| 8,617,439 | B2 | 12/2013 | Pervan et al. | |
| 2001/0006704 | A1 | 7/2001 | Chen et al. | |
| 2001/0009309 | A1 | 7/2001 | Taguchi et al. | |
| 2002/0054994 | A1 | 5/2002 | Dupre et al. | |
| 2002/0100231 | A1 | 8/2002 | Miller | |
| 2003/0056873 | A1 | 3/2003 | Nakos et al. | |
| 2003/0102094 | A1 | 6/2003 | Tirri et al. | |
| 2004/0191547 | A1 | 9/2004 | Oldorff | |
| 2004/0202857 | A1 | 10/2004 | Singer | |
| 2004/0206036 | A1 | 10/2004 | Pervan | |
| 2004/0237436 | A1 | 12/2004 | Zuber et al. | |
| 2005/0003099 | A1 | 1/2005 | Quist | |
| 2005/0079780 | A1 | 4/2005 | Rowe et al. | |
| 2005/0252130 | A1 | 11/2005 | Martensson | |
| 2006/0008630 | A1 | 1/2006 | Thiers et al. | |
| 2006/0024465 | A1 | 2/2006 | Briere | |
| 2006/0032175 | A1 | 2/2006 | Chen et al. | |
| 2006/0070321 | A1 | 4/2006 | Au | |
| 2006/0145384 | A1 | 7/2006 | Singer | |
| 2006/0183853 | A1 | 8/2006 | Sczepan | |
| 2007/0166516 | A1 | 7/2007 | Kim et al. | |
| 2007/0184244 | A1 | 8/2007 | Doehring | |
| 2007/0207296 | A1 | 9/2007 | Eisermann | |
| 2007/0218260 | A1 | 9/2007 | Miclo et al. | |
| 2007/0224438 | A1 | 9/2007 | Van Benthem et al. | |
| 2007/0256804 | A1 | 11/2007 | Garcis Espino et al. | |
| 2008/0000417 | A1 * | 1/2008 | Pervan et al. | 118/107 |
| 2008/0032120 | A1 | 2/2008 | Braun | |
| 2008/0090032 | A1 | 4/2008 | Perrin et al. | |
| 2008/0176039 | A1 | 7/2008 | Chen et al. | |
| 2008/0263985 | A1 | 10/2008 | Hasch et al. | |
| 2009/0124704 | A1 | 5/2009 | Jenkins | |
| 2009/0145066 | A1 | 6/2009 | Pervan | |
| 2009/0155612 | A1 * | 6/2009 | Pervan et al. | 428/498 |
| 2009/0208646 | A1 | 8/2009 | Kreuder et al. | |
| 2009/0311433 | A1 | 12/2009 | Wittmann | |
| 2010/0092731 | A1 | 4/2010 | Pervan et al. | |
| 2010/0223881 | A1 | 9/2010 | Kalwa | |
| 2010/0291397 | A1 | 11/2010 | Pervan et al. | |
| 2010/0300030 | A1 | 12/2010 | Pervan et al. | |
| 2010/0319282 | A1 | 12/2010 | Ruland | |
| 2010/0323187 | A1 | 12/2010 | Kalwa | |
| 2010/0330376 | A1 | 12/2010 | Trksak | |
| 2011/0175251 | A1 | 7/2011 | Ziegler et al. | |
| 2011/0177319 | A1 | 7/2011 | Ziegler et al. | |
| 2011/0177354 | A1 | 7/2011 | Ziegler et al. | |
| 2011/0247748 | A1 | 10/2011 | Pervan et al. | |
| 2011/0250404 | A1 | 10/2011 | Pervan et al. | |
| 2011/0293823 | A1 | 12/2011 | Bruderer et al. | |
| 2011/0293906 | A1 | 12/2011 | Jacobsson | |
| 2012/0263878 | A1 | 10/2012 | Ziegler et al. | |
| 2012/0263965 | A1 | 10/2012 | Persson et al. | |
| 2012/0264853 | A1 | 10/2012 | Ziegler et al. | |
| 2012/0308774 | A1 | 12/2012 | Persson et al. | |
| 2013/0092314 | A1 | 4/2013 | Ziegler et al. | |
| 2013/0095315 | A1 | 4/2013 | Pervan et al. | |
| 2013/0189534 | A1 | 7/2013 | Pervan et al. | |
| 2013/0269863 | A1 | 10/2013 | Pervan et al. | |
| 2013/0273244 | A1 | 10/2013 | Vetter et al. | |
| 2013/0273245 | A1 | 10/2013 | Ziegler et al. | |

FOREIGN PATENT DOCUMENTS

| | | | |
|---|---|---|---|
| CH | 298 894 | | 8/1954 |
| DE | 1 815 312 | A1 | 7/1969 |
| DE | 7148789 | | 4/1972 |
| DE | 29 39 828 | A1 | 4/1981 |
| DE | 33 34 921 | A1 | 4/1985 |
| DE | 42 36 266 | A1 | 5/1993 |
| DE | 202 14 532 | U1 | 2/2004 |
| DE | 103 31 657 | A1 | 2/2005 |
| DE | 10 2004 050 278 | A1 | 4/2006 |
| DE | 20 2006 007 797 | U1 | 8/2006 |
| DE | 10 2005 046 264 | A1 | 4/2007 |
| DE | 10 2006 024 593 | A1 | 12/2007 |
| EP | 0 129 430 | A2 | 12/1984 |
| EP | 0 129 430 | B1 | 1/1990 |
| EP | 0 355 829 | A2 | 2/1990 |
| EP | 0 611 408 | A1 | 12/1993 |
| EP | 0 592 013 | A2 | 4/1994 |
| EP | 0 656 443 | A1 | 6/1995 |
| EP | 0 611 408 | B1 | 9/1996 |
| EP | 0 732 449 | A1 | 9/1996 |
| EP | 0 744 477 | A2 | 11/1996 |
| EP | 0 914 914 | A2 | 5/1999 |
| EP | 0 744 477 | B1 | 1/2000 |
| EP | 1 193 288 | A1 | 4/2002 |
| EP | 1 209 199 | A1 | 5/2002 |
| EP | 1 249 322 | A1 | 10/2002 |
| EP | 1 498 241 | A2 | 1/2005 |
| EP | 1 507 664 | A1 | 2/2005 |
| EP | 1 507 664 | B1 | 2/2005 |
| EP | 1 584 378 | A1 | 10/2005 |
| EP | 1 681 103 | A2 | 7/2006 |
| EP | 1 690 603 | A1 | 8/2006 |
| EP | 1 847 385 | A1 | 10/2007 |
| EP | 0 732 449 | B1 | 8/2008 |
| EP | 1 961 556 | A1 | 8/2008 |
| EP | 1 985 464 | A1 | 10/2008 |
| EP | 1 997 623 | A1 | 12/2008 |
| EP | 2 025 484 | A1 | 2/2009 |
| EP | 1 454 763 | B1 | 8/2009 |

(56) References Cited

FOREIGN PATENT DOCUMENTS

| | | | | |
|---|---|---|---|---|
| EP | 2 226 201 | A1 | 9/2010 | |
| EP | 2 246 500 | A2 | 11/2010 | |
| EP | 2 264 259 | A2 | 12/2010 | |
| EP | 2 272 667 | A1 | 1/2011 | |
| EP | 2 272 668 | A1 | 1/2011 | |
| EP | 2 305 462 | A1 | 4/2011 | |
| EP | 1 847 385 | B1 | 9/2011 | |
| FR | 2 264 259 | A1 | 2/2006 | |
| GB | 984 170 | A | 2/1965 | |
| GB | 1090450 | | 11/1967 | |
| GB | 2 248 246 | A | 4/1992 | |
| JP | 2-229002 | A | 9/1990 | |
| JP | 1 1-291 203 | A | 10/1999 | |
| JP | 2001-287208 | A | 10/2001 | |
| JP | 2003-311717 | A | 11/2003 | |
| JP | 2003-311718 | A | 11/2003 | |
| JP | 2005-034815 | A | 2/2005 | |
| JP | 2005-074682 | A | 3/2005 | |
| JP | 2005-170016 | A | 6/2005 | |
| JP | 2005-219215 | A | 8/2005 | |
| JP | 3705482 | B2 | 10/2005 | |
| JP | 2005-307582 | A | 11/2005 | |
| JP | 2007-216692 | A | 8/2007 | |
| JP | 2007-268843 | A | 10/2007 | |
| JP | 2008-188826 | A | 8/2008 | |
| SE | 469 326 | B | 6/1993 | |
| WO | WO 92/06832 | A1 | 4/1992 | |
| WO | WO 94/00280 | A1 | 1/1994 | |
| WO | WO 95/06568 | A1 | 3/1995 | |
| WO | WO 00/22225 | A1 | 4/2000 | |
| WO | WO 00/44576 | A1 | 8/2000 | |
| WO | WO 01/48333 | A1 | 7/2001 | |
| WO | WO 01/64408 | A1 | 9/2001 | |
| WO | WO 01/92037 | A2 | 12/2001 | |
| WO | WO 02/42167 | A2 | 5/2002 | |
| WO | WO 03/078761 | A1 | 9/2003 | |
| WO | WO 03/095202 | A1 | 11/2003 | |
| WO | WO 2004/042168 | A1 | 5/2004 | |
| WO | WO 2004/050359 | A1 | 6/2004 | |
| WO | WO 2005/054600 | A1 | 6/2005 | |
| WO | WO 2005/066431 | A2 | 7/2005 | |
| WO | WO 2006/007413 | A1 | 1/2006 | |
| WO | WO 2006/013469 | A1 | 2/2006 | |
| WO | WO 2006/043893 | A1 | 4/2006 | |
| WO | WO 2007/042258 | A1 | 4/2007 | |
| WO | WO2007059294 | * | 5/2007 | ..... B05D 3/02 |
| WO | WO 2009/065768 | A1 | 5/2009 | |
| WO | WO 2009/065769 | A2 | 5/2009 | |
| WO | WO 2009/065769 | A3 | 5/2009 | |
| WO | WO 2009/124704 | A1 | 10/2009 | |
| WO | WO 2010/094500 | A1 | 8/2010 | |
| WO | WO 2011/141851 | A2 | 11/2011 | |
| WO | WO 2012/004699 | A2 | 1/2012 | |

OTHER PUBLICATIONS

U.S. Appl. No. 13/444,653, HÅkansson et al.
U.S. Appl. No. 13/445,379, Ziegler et al.
U.S. Appl. No. 13/469,799, Persson et al.
U.S. Appl. No. 61/612,672, Vetter et al.
**Ziegler, Göran, et al., U.S. Appl. No. 13/444,604, entitled "A Powder Mix and Method for Producing a Building Panel," filed in the U.S. Patent and Trademark Office Apr. 11, 2012.
** Persson, Hans, et al., U.S. Appl. No. 13/444,653, entitled "Powder Based Balancing Layer," filed in the U.S. Patent and Trademark Office Apr. 11, 2012.
** Ziegler, Göran, et al, U.S. Appl. No. 13/445,379, entitled "Method of Manufacturing a Layer," filed in the U.S. Patent and Trademark Office Apr. 12, 2012.
**Persson, Hans, et al., U.S. Appl. No. 13/469,799, entitled "Method of Producing a Powder Layer or a Granular Layer," filed in the U.S. Patent and Trademark Office May 11, 2012.
**Vetter, Georg, et al., U.S. Appl. No. 61/612,672, entitled "Method for Producing a Building Panel," filed in the U.S. Patent and Trademark Office Mar. 19, 2012.
Engstrand, Ola (Contact)/Valinge Innovation, Technical Disclosure entitled "Fibre Based Panels With a Wear Resistance Surface," Nov. 17, 2008, IP.com No. IPCOM000176590D, IP.com PriorArtDatabase 76 pages.
Engstrand, Ola (Contact)/Valinge Innovation, Technical Disclosure entitled "WFF Embossing," May 15, 2009, IP.com No. IPCOM000183105D, IP.com PriorArtDatabase, 36 pages.
U.S. Appl. No. 61/485,930, Persson et al.
U.S. Appl. No. 61/557,643, Persson et al.
U.S. Appl. No. 61/557,734 HÅkansson et al.
**Persson, Hans, et al., U.S. Appl. No. 61/485,930, entitled "Scattering," filed in the U.S. Patent and Trademark Office May 13, 2011.
**Persson, Hans, et al., U.S. Appl. No. 61/557,643, entitled "Scattering", filed in the U.S. Patent and Trademark Office Nov. 9, 2011.
**HÅkansson, Niclas, et al., U.S. Appl. No. 61/557,734, entitled "Powder Based Balancing Layer" filed in the U.S. Patent and Trademark Office Nov. 9, 2011.
International Search Report issued in PCT/SE2010/051474, Apr. 21, 2011, 5 pp., Swedish Patent Office, Stockholm, SE.
Parquet International, "Digital Printing is still an expensive process," Mar. 2008, cover page/pp. 78-79, www.parkettmagazin.com.
Floor Daily, "Shaw Laminates: Green by Design," Aug. 13, 2007, 1 pg, Dalton, GA.
U.S. Appl. No. 61/349,950, Jacobsson.
U.S. Appl. No. 61/474,485, Ziegler et al.
U.S. Appl. No. 61/474,498, HÅkansson et al.
U.S. Appl. No. 12/976,213, Ziegler et al.
U.S. Appl. No. 12/976,329, Ziegler et al.
U.S. Appl. No. 12/976,350, Ziegler et al.
U.S. Appl. No. 13/084,955, Pervan et al.
U.S. Appl. No. 13/084,974, Pervan et al.
Jacobsson, U.S. Appl. No. 61/349,950, entitled "Production Method," filed May 31, 2010.
Ziegler, Goran,et al., U.S. Appl. No. 61/474,485, entitled "Pre Treated Powder," filed in the U.S. Patent and Trademark Office Apr. 12, 2011.
HÅkansson, Niclas, et al., U.S. Appl. No. 61/474,498, entitled "Powder Based Balancing Layer," filed in the U.S. Patent and Trademark Office Apr. 12, 2011.
Ziegler, Goran et al. U.S. Appl. No. 12/976,213, entitled "Heat and Pressure Generated Design," filed in the U.S. Patent and Trademark Office Dec. 22, 2010.
Ziegler, Goran et al. U.S. Appl. No. 12/976,329, entitled "Bright Coloured Surface Layer," filed in the U.S. Patent and Trademark Office Dec. 22 2010.
Ziegler, Goran et al. U.S. Appl. No. 12/976,350, entitled "Fibre Based Panels with a Decorative Wear Resistance Surface," filed in the U. S. Patent and Trademark Office Dec. 22, 2010.
Pervan, Darko, et al., U.S. Appl. No. 13/084,955, entitled "Powder Overlay," filed in the U.S. Patent and Trademark Office Apr. 12, 2011.
Pervan, Darko, et al., U.S. Appl. No. 13/084,974, entitled "Digitally Injected Designs in Powder Surfaces," filed in the U.S. Patent and Trademark Office Apr. 12, 2011.
U.S. Appl. No. 13/693,979, Pervan et al.
U.S. Appl. No. 13/705,310, Ziegler et al.
**Pervan, Darko, et al., U.S. Appl. No. 13/693,979, entitled "Recycling of Laminate Floorings," filed in the U.S. Patent and Trademark Office Dec. 4, 2012.
**Ziegler, Göran, et al., U.S. Appl. No. 13/705,310, entitled "Fibre Based Panels with a Decorative Wear Resistance Surface," filed in the U.S. Patent and Trademark Office Dec. 5, 2012.
U.S. Appl. No. 13/912,564, Ziegler et al.
U.S. Appl. No. 13/912,587, Pervan et al.
Ziegler, Göran, et al., U.S. Appl. No. 13/912,564, entitled "Bright Coloured Surface Layer," filed in the U.S. Patent and Trademark Office Jun. 7, 2013.
Pervan, Darko, et al., U.S. Appl. No. 13/912,587, entitled "Powder Overlay," filed in the U.S. Patent and Trademark Office Jun. 7, 2013.
U.S. Appl. No. 61/751,393, Pervan et al.
Pervan, Darko, et al., U.S. Appl. No. 61/751,393, entitled "Method of Producing a Building Panel and a Building Panel," filed in the U.S. Patent and Trademark Office Jan. 11, 2013.

(56) References Cited

OTHER PUBLICATIONS

Engstrand, Ola (Contact)/Valinge Innovation, Technical Disclosure entitled "VA063 VA064 Scattering and Powder Backing," Nov. 11, 2011, IP.com No. IPCOM000212422D, IP.com PriorArtDatabase, 34 pages.
U.S. Appl. No. 13/793,971, Pervan et al.
U.S. Appl. No. 13/804,355, Vetter et al.
**Pervan, Darko, et al., U.S. Appl. No. 13/793,971, entitled "Wood Fibre Based Panels with a Thin Surface Layer," filed in the U.S. Patent and Trademark Office Mar. 14, 2013.
**Vetter, Georg, et al., U.S. Appl. No. 13/804,355, entitled "Method for Producing a Building Panel," filed in the U.S. Patent and Trademark Office Mar. 14, 2013.
U.S. Appl. No. 14/151,973, Pervan et al.
**Pervan, Darko, et al., U.S. Appl. No. 14/151,973 entitled "A Method of Producing a Building Panel and a Building Panel", filed in the U.S. Patent and Trademark Office Jan. 10, 2014.
U.S. Appl. No. 14/089,928, Pervan et al.
**Pervan, Darko, et al., U.S. Appl. No. 14/089,928 entitled "Recycling of Laminate Floors," filed in the U.S. Patent and Trademark Office Nov. 26, 2013.
BTLSR Toledo, Inc. website. http://www.bltresins.com/more.html. "Advantages to Using Powdered Resins," May 26, 2007, 2 pages, per the Internet Archive WayBackMachine.
Nimz, H.H., "Wood," Ullmann's Encyclopedia of Industrial Chemistry, published online Jun. 15, 2000, pp. 453-505, vol. 39, Wiley-VCH Verlag GmbH & Co. KGaA, Weinheim, DE.
Pervan, Darko, U.S. Appl. No. 14/237,617, entitled "Panel Coating," filed in the U.S. Patent and Trademark Office on Feb. 7, 2014.
Ziegler, Göran, et al., U.S. Appl. No. 14/184,299, entitled "Heat and Pressure Generated Design", filed in the U.S. Patent and Trademark Office on Feb. 19, 2014.
Pervan, Darko, et al., U.S. Appl. No. 14/192,169, entitled "Fibre Based Panels with a Wear Resistance Surface", filed in the U.S. Patent and Trademark Office on Feb. 27, 2014.
Ziegler, Göran, et al., U.S. Appl. No. 14/247,839, entitled "A Powder Mix and a Method for Producing a Building Panel," filed in the U.S. Patent and Trademark Office on Apr. 8, 2014.

* cited by examiner

FIBRE BASED PANELS WITH A DECORATIVE WEAR RESISTANCE SURFACE

CROSS REFERENCE TO RELATED APPLICATIONS

The present application claims the benefit of U.S. Provisional Application No. 61/295,350, filed on Jan. 15, 2010, and claims the benefit of Swedish Application No. 1050038-7, filed on Jan. 15, 2010. The entire contents of each of U.S. Provisional Application No. 61/295,350 and Swedish Application No. 1050038-7 are hereby incorporated herein by reference.

TECHNICAL FIELD

The disclosure generally relates to the field of fibre-based panels with wear resistant surfaces for building panels, preferably floor panels. The disclosure relates to building panels with such wear resistance surface and particularly to production methods to produce such panels.

FIELD OF APPLICATION

The present disclosure is particularly suitable for use in floating floors, which are formed of floor panels comprising a core and a decorative wear resistant solid surface layer comprising fibres, binders and wear resistant particles as described in WO 2009/065769. The following description of technique, problems of known systems and objects and features of the invention will therefore, as a non-restrictive example, be aimed above all at this field of application and in particular at floorings which are similar to traditional floating wood fibre based laminate floorings. The disclosure does not exclude floors that are glued down to a sub floor.

It should be emphasized that the disclosure can be used to produce a complete panel or a separate surface layer, which is for example applied to a core in order to form a panel. The disclosure can also be used in applications as for example wall panels, ceilings, and furniture components and similar.

BACKGROUND

Wood fibre based direct pressed laminated flooring usually comprises a core of a 6-12 mm fibre board, a 0.2 mm thick upper decorative surface layer of laminate and a 0.1-0.2 mm thick lower balancing layer of laminate, plastic, paper or like material.

The surface layer of a laminate floor is characterized in that the decorative and wear properties are generally obtained with two separate layers one over the other.

The printed decorative paper and the overlay are impregnated with melamine resin and laminated to a wood fibre based core under heat and pressure.

Recently new "paper free" floor types have been developed with solid surfaces comprising a substantially homogenous mix of fibres, binders and wear resistant particles.

The wear resistant particles are preferably aluminium oxide particles, the binders are preferably thermosetting resins such as amino resins and the fibres are preferably wood based. Other suitable wear resistant materials are, for example, silica or silicon carbide. In most applications decorative particles such as for example colour pigments are included in the homogenous mix. In general all these materials are preferably applied in dry form as a mixed powder on a HDF core and cured under heat and pressure to a 0.1-1.0 mm solid layer.

Several advantages over known technology and especially over conventional laminate floorings can be obtained:

- The wear resistant surface layer, which is a homogenous mix, can be made much thicker and a wear resistance is achieved, which is considerably higher.
- New and very advanced decorative effects can be obtained with deep embossing and with separate decorative materials, which can be incorporated into the homogenous surface layer and coordinated with the embossing.
- An increased impact resistance can be reached with a homogenous surface layer, which is thicker and has a higher density.
- The homogenous surface layer can comprise particles that have a positive impact on sound and moisture properties.
- Production costs can be reduced since low cost and even recycled materials can be used and several production steps can be eliminated.

Powder technology is very suitable to produce a decorative surface layer, which is a copy of stone and ceramics. It is however more difficult to create designs such as, for example, wood decors.

Powder based floors could reach a much higher market share if advanced designs similar to, for example, wood floorings could be made in a cost efficient way as described in this application.

DEFINITION OF SOME TERMS

In the following text, the visible surface of the installed floor panel is called "front side", while the opposite side of the floor panel, facing the sub floor, is called "rear side". By "surface layer" are meant all layers which give the panel its decorative properties and its wear resistance and which are applied to the core closest to the front side covering preferably the entire front side of the floorboard. By "decorative surface layer" is meant a layer, which is mainly intended to give the floor its decorative appearance. "Wear layer" relates to a layer, which is mainly adapted to improve the durability of the front side.

By "horizontal plane" is meant a plane, which extends parallel to the outer part of the surface layer. By "horizontally" is meant parallel to the horizontal plane and by "vertically" is meant perpendicular to the horizontal plane. By "up" is meant towards the front side and by "down" towards the rear side.

KNOWN TECHNIQUE AND PROBLEMS THEREOF

FIG. 1 shows a known embodiment of the new "paper free" floor type with a solid surface 5 comprising a mixture of fibres, preferably wood fibres 14, small hard wear resistant particles 12, 12' and a binder 19. The wood fibres are generally unrefined and of the same type as used in HDF and particleboard. They comprise natural resins such as lignin. The wear resistant particles (12,12') are preferably aluminium oxide particles. The surface layer comprises preferably also colour pigments 15 or other decorative materials or chemicals.

A preferable binder is melamine or urea formaldehyde resin. Any other binder, preferably synthetic thermosetting resins, can be used. The solid layer 5 is generally applied in dry powder form on a wood based core 6, such as for example HDF, and cured under heat and pressure. The binder 19 penetrates into the upper part of the core 34 and connects the solid surface layer to the core.

An advanced decorative pattern can be applied in line on a scattered or pre-pressed surface with for example an ink jet digital device, which allows the ink to penetrate into the powder. The major disadvantages are that digital ink yet printing is rather expensive and the ink does not penetrate sufficiently into the powder and a high wear resistance cannot be obtained.

OBJECTS AND SUMMARY

An overall objective of embodiments of the disclosure is to provide a building panel, preferably a floor panel with a solid surface, which has better design properties and/or cost structure than the known building panels.

A first objective of embodiments of the disclosure is to provide a solid laminate panel, preferably a floor panel, with an advanced surface design, which can be combined with a high wear resistance.

A second objective of embodiments of the disclosure is to provide a cost efficient method to produce advanced surface designs.

According to a first aspect of the disclosure a building panel is provided comprising a decorative surface connected to a core. The surface comprises at least two homogenous layers, a lower sub layer and an upper decorative layer. Each of the layers comprises fibres, colour substance, preferably a colour pigment and a binder. The upper decorative layer comprises wear resistant particles and a first colour and the sub layer a second colour. The first and second colours are different, a different colour including different shades of the same color, and particles or portions comprising the second colour are located on the upper parts of the decorative surface layer.

According to a first aspect of the disclosure a method of manufacturing a building panel having a decorative surface connected to a core is provided. The surface comprises at least two homogenous layers, a lower sub layer and an upper decorative layer. Each of the layers comprising fibres, colour substance, preferably a colour pigment, a binder and wear resistant particles whereby the method comprises the steps of:

- Applying the layers comprising a mix of fibres, binder, wear resistant particles and colour substance on a core wherein the layers comprise different colours.
- Displacing particles from their original position such that particles from the sub layer are visible on the decorative surface.
- Curing the layers by providing heat and pressure.

The panel and the production method according to the invention make it possible to produce very advance decorative patterns with high wear resistance in a cost effective way.

BRIEF DESCRIPTION OF THE DRAWINGS

The disclosure will in the following be described in connection to preferred embodiments and in greater detail with reference to the appended exemplary drawings, wherein.

DETAILED DESCRIPTION OF EMBODIMENTS

Designs in Wood Fiber Floor—WFF—with a solid decorative surface comprising a mixture of fibres, preferably wood fibres 14, small hard wear resistant particles 12, 12', an optional colorant, and a binder 19 can be produced in many different ways; for example, by using different pressure and heat in the pressing operation.

Figure 1:
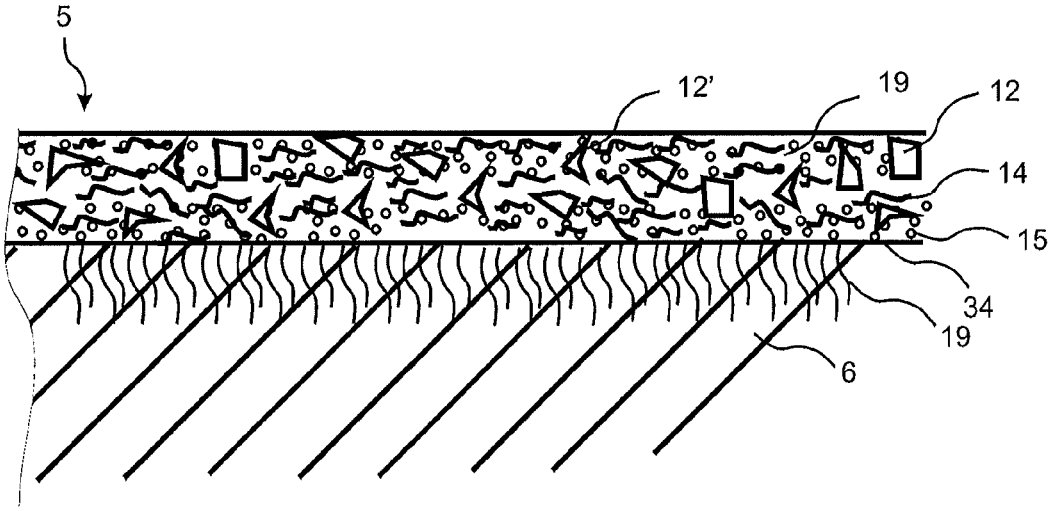
FIG. 1 illustrates a known solid laminate surface.
Figure 2A:
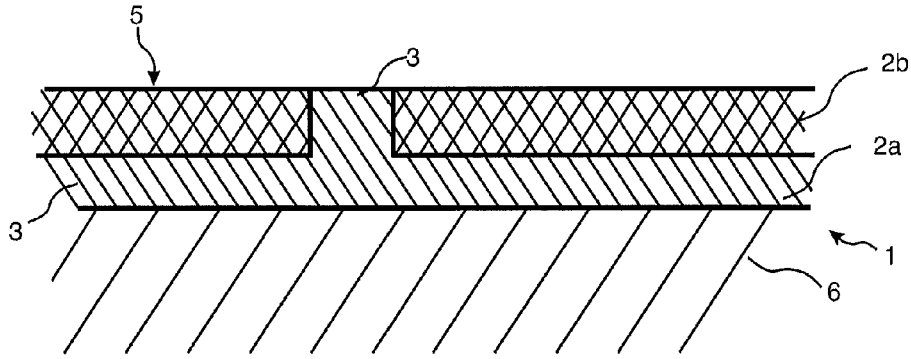
FIGS. 2*a-b* illustrate a methods to form a decorative surface.

A cost effective method is shown in FIG. 2*a* where the surface 5 comprises at least two homogenous layers, a lower sub layer 2*a* and an upper decorative layer 2*b*. Each of the layers comprises fibres, colour substance, preferably a colour pigment and a binder. The upper decorative layer comprises wear resistant particles and a first colour and the sub layer a second colour. The first and second colours are different, for example, black, white or different gray colours, etc.

Particles or portions 3 from the second layer 2*a* comprising a different colour than the upper decorative surface layer 2*b* are in one embodiment of the invention mechanically displaced from their original position such that they are visible on the decorative surface as shown in FIG. 2*a*.

Figure 2B:
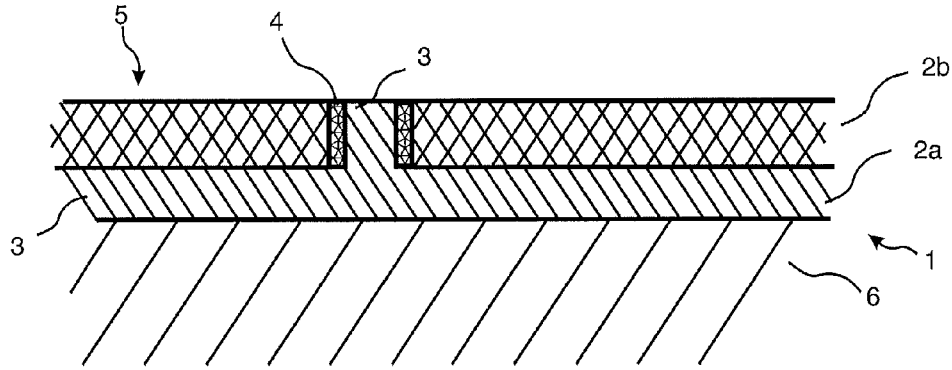

FIG. 2*b* shows surface portions 4 that consist of a mixture of particles from the upper 2*b* and the lower 2*a* layers.

Figure 3A:
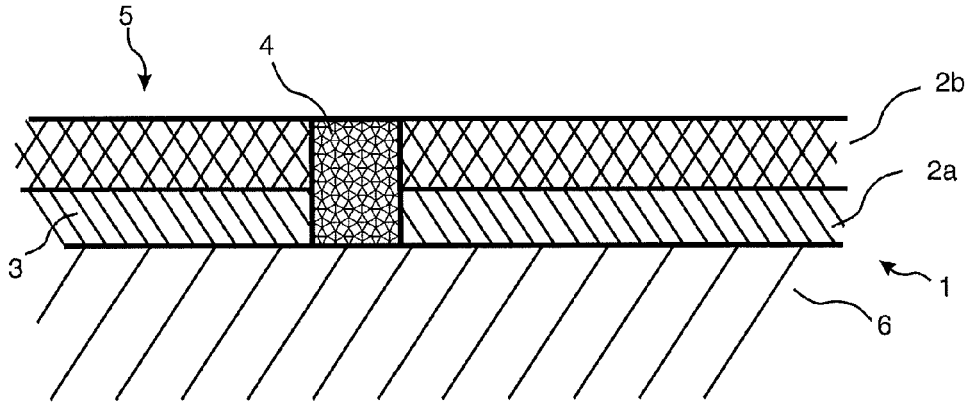
FIGS. 3*a-b* illustrate alternative methods to form a decorative surface.

FIG. 3*a* shows a mix of particles 4 from the two layers 2*a*, 2*b* that extent from the surface and to the core 6.

Figure 3B:
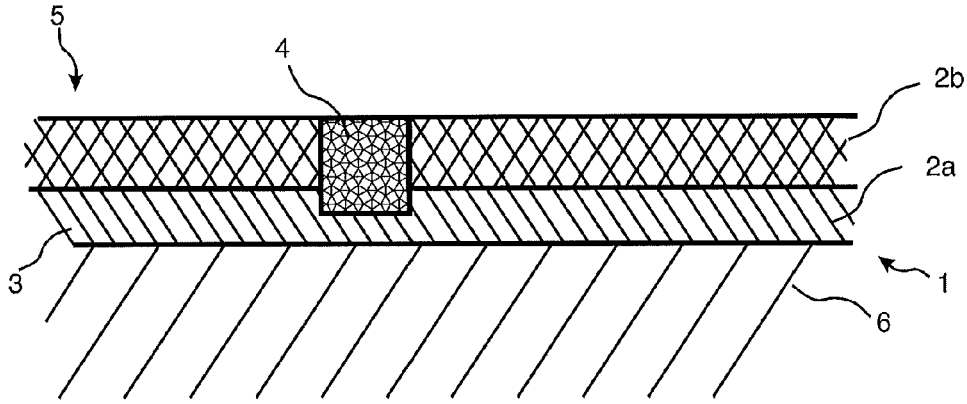

FIG. 3*b* shows an embodiment where the mixed particles 4 from the two layers 2*a*, 2*b* are spaced upwardly from the core 6.

Such a displacement of particles between different layers could be obtained by using a robot using different kind of tools like a metallic needle that scratch into the powder layers, by using vacuum to remove WFF powder partly, by adding WFF powder in another color than the base layer that displaces the particles in the lower layer, by adding WFF powder through a template or a screen or a rotary screen which have a design that are in register with the press plate in order to create a WFF floor product where surface texture and the design in the floor are in register, i.e., in alignment.

By adding different kind of separate preferably colored materials like colored diamante, colored aluminium oxide, different kinds of colored stones, all in different sizes and shapes, particles from the lower layer 2*a* could be displaced, mixed and made visible at the surface.

The pressed surface can in a further production step be treated with laser to create different kinds of design effect, for example, letters that can create logos.

The pressed surface can also be treated with a steel brush in order to remove softer material in the already pressed surface.

The surface 5 could also be pressed with a structured press plate that is coordinated with the pattern created by the displacement of particles between the layers.

More than two layers can be applied comprising different or partly the same colours and displacement of particles could be made in several steps and with different mechanical devices in order to form advanced decorative patterns.

Embodiments of the disclosure also include the colour substances being design substances that may make design aspect(s) of the portion of the lower sub layer visible at the surface different from design aspect(s) of the upper decorative layer. Exemplary design substances include substances effecting texture, reflectivity, shine, luminescence, transparency, etc.

Example 1

On a HDF board with a thickness of 9.8 mm, two backing papers NKR 140 were fixed on backside for balancing, a WFF powder formulation was added, consisting of 24.5% wood fiber, 17.5% aluminium oxide, 10.5% titanium dioxide as pigment and 47.5% melamine resin.

The WFF powder mix was applied by a so-called scattering machine, which distributed the WFF powder material evenly over the HDF surface. The total amount of WFF powder was 550 g/m$^2$. The WFF powder was fixed on the HDF board by spraying a water solution consisting of 97% de-ionize water, 1% BYK-345 (reducing surface tension) and 2% of Pat 622/E (release agent) on the WFF powder.

The above material was placed into a so-called DPL press. The surface texture consists of a special press plate with hills and valleys with about 700 microns in difference in highest and lowest part. Such a deep press plate can't be used when pressing DPL and HPL in the traditional way since the melamine impregnated papers cracks during the pressing.

The WFF powder composition makes it possible to use very deep press plates and this gives a very nice and good-looking surface after pressing at 40 bar for 25 sec with a temperature on the upper daylight at 160° C. and the bottom daylight at 165° C.

The pressed surface shows difference in color appearance with lighter parts on the hills and darker color in the valleys.

By changing the relation between melamine and wood fiber, changes can be created in the relation between the light and darker parts.

Example 2

Example 1 was repeated with one WFF powder layer direct on the HDF board and a second partial WFF powder layer with another color was applied through a special made template. This template was made to match the structured press plate so that the structure of the press plate and the partial layer were matching each other.

After pressing as in Example 1, the material was cured and fixed to a core and a panel with a solid surface layer and a design with the décor and the surface texture structure in register was created.

Example 3

Example 2 was repeated with one WFF powder layer direct on the HDF board and a second partial layer with another color and 50% higher amount of aluminium oxide. The second layer was applied through a special made template.

This template was made to mach the press plate so the structure of the press plate and the partial layer were matching each other.

After pressing as in Example 1, the material was cured to a homogenous solid floor surface comprising a design with the décor and the surface texture structure in register.

With this, construction embossed in register was created with a much higher wear resistance in the higher parts of the floor surface, which are more exposed to wear than the flat or embossed parts.

Example 4

From the WFF floor material produced in example 3 materials were treated with a hard metallic brush.

The metallic brush removes parts of the softer material in the valleys and the hills were intact. This preparation creates an exact match between the template and the structure of the press plate.

Example 5

Example 1 was repeated, but before final pressing the WFF powder was scratched and particles were displaced with an ABB robot. The robot was programmed to create lines in the WFF powder material, copying a stone tile. As a "pencil" different materials with different shapes were used. A 6 mm broad metallic stick was used in one embodiment and a more narrow "pencil" about 1 to 3 mm was used in other embodiments.

After this mechanically created design where no additional decorative materials were added after the application of the different layers, the WFF powder was cured and fixed to the HDF board as in Example 1.

The very structured press plate with deep embossing was replaced with a flat press plate and a surface with advanced stone like patterns was obtained by both the broader and the narrower "pencils".

Example 6

Example 1 was repeated but a second scattering machine added a second layer of WFF powder formulation with a different color.

An ABB robot, with a rather narrow "pencil", was programmed to create a company logo, in this case a "Välinge" logo and programmed to keep a specific distance between the outer end of the "pencil" and the applied powder layers over the HDF core. The "pencil" was programmed to go through the first powder layer and a part of the second in order to create a good-looking logo.

After pressing as in Example 1, but changing the very structured press plate to a flat press plate, the material was cured to a homogenous floor containing a nice looking Välinge logo.

Example 7

Example 5 was repeated but instead of a narrow "pencil", vacuum was connected to a thin drill with holes in order to suck away the powder material in a controlled way in order to create a Välinge logo and other advanced designs. After pressing as in Example 1, but changing the very structured press plate to a flat press plate, the material was cured to a homogenous floor containing a nice looking Välinge logo.

Example 8

Example 6 was repeated, but instead of vacuum, high-pressure air was connected to a drill with holes, in order to blow away material in controlled way in order to create a Välinge logo.

After pressing as in Example 1, but changing the very structured press plate to a flat press plate, the material was cured to a homogenous floor containing a nice looking Välinge logo.

Example 9

Example 1 was repeated with one black layer of WFF material.

An ABB robot was programmed and equipped with a "pencil" consisting of a thin drill. The drill was adjusted just to touch the top of the black WFF material. This soft created design effect, look like a "watermark" in a paper, after pressing the WFF floor as in example 1, but changing the very structured press plate to a flat press plate.

Example 10

Example 1 was repeated with one layer of WFF powder formulation direct on the HDF board and a second partial layer with different color added with a second scattering machine. Due to the different amount of material added and different colors a pattern of a stone replica was created. After pressing as in Example 1, but using a slate surface texture, the material was fixed to a homogenous floor containing a nice looking stone replica.

Example 11

Example 10 was repeated but the partial layer was applied first direct on the HDF board and a second full WFF powder layer with a different color was applied above.

Due to the different amount of material added and different colors a pattern was created. After pressing as in Example 1, but using a slate surface texture, the material was fixed to a homogenous floor containing a nice looking stone replica.

Example 12

Two different WFF layers were added with two scattering machines, but the second WFF powder layer was applied as a much thinner layer, just the half amount as the first layer. After that the WFF powder was fixed to HDF board with the special water solution, a special type of metallic powder called Granostar was randomly applied to the top of the still wet surface of WFF powder.

Granostar could be e.g. gold, copper, silver powder in different sizes.

After pressing as in Example 1, but using a granite surface texture, the material was fixed to a homogenous floor with a nice looking stone or fantasy design. The first WFF powder layer could now bee seen through the second layer and the Granostar particles could be seen as a third decorative effect. This method was also combined with the above mentioned methods to displace particles between separate layers.

Example 13

Example 12 was repeated; two different WFF layers were added with two scattering machines, but the second WFF powder layer had a thickness which was just the half the amount of the first layer.

A third scattering machine was applied randomly a third WFF powder color over the already two WFF layers.

An ABB robot was used that was programmed to create lines randomly in the already applied WFF powder.

After pressing as in Example 1, but using a slate surface texture the material was cured to a homogenous floor with a nice looking stone design. The first WFF powder layer could now bee seen through the second layer.

The last added lines by the robot, even intensified the feeling of a real stone.

Example 14

Example 1 was repeated with one plain color layer of WFF material and a flat so called high gloss surface texture press plate was used to create a high gloss surface. After pressing as in example 1 it was found that the gloss level on the WFF floor, was rather low, around 35-40, measured at 60°.

Example 15

The WFF floor from example 14 had a rather low gloss level. In order to increase the gloss level the flat surface texture was polished with a sand paper containing small aluminium oxide particles. Also, other hard particles, such as diamond powder, were used. After this treatment the gloss level increased up to around 90 measured at 60°.

Example 16

Example 14 was repeated but the flat high gloss press plate was replaced with a wood surface texture. This surface texture consists of hills and valleys. The gloss level of this surface texture is around 7 at 60°.

When using the equipment in example 15 it was possible to increase the gloss levels on the hills of the surface texture up to around 90 at 60°. In the valleys the gloss level was around 7 at 60°.

Example 17

The high gloss WFF floor laminate, produced in example 14, with a flat high gloss surface texture and plain color layer was used as a base material for creating different kind of patterns, figures, logos and other types of decorative effects with a laser beam. This design method was also combined with the displacement of particles between different layers.

All the above described methods to create advanced flat or embossed decorative surfaces with and without material displacement between different layers applied on a core could be combined.

The invention claimed is:

1. A method of manufacturing a building panel having a decorative surface connected to a core wherein the surface comprises at least two homogenous layers, the at least two homogenous layers comprising a lower sub layer and an upper decorative layer, the upper decorative layer comprising a first powder mix of fibres, a first colour substance, a binder and wear resistant particles, the lower sub layer comprising a second powder mix of fibres, a second colour substance, and a binder, whereby the method comprises the steps of:

applying the lower sub layer comprising the second powder mix over a core, and applying the upper decorative layer comprising the first powder mix over the lower sub layer wherein the colour of the upper decorative layer is different from the colour of the lower sub layer;

displacing a portion of the first powder mix from an original position such that a portion of the second powder mix from the sub layer is visible on the decorative surface; and after displacement, curing the upper decorative layer and the lower sub layer by providing heat and pressure, such that an upper surface of the visible portion of the second powder mix from the sub-layer is in the same plane as an upper surface of the first powder mix.

2. The method as claimed in claim 1, wherein the panel is a floor panel.

3. The method as claimed in claim 1, wherein the core is a High Density Fibreboard board.

4. The method as claimed in claim 1, wherein the first colour substance comprises colour pigments and wood fibres.

5. The method as claimed in claim 1, wherein the first colour substance comprises a first colour pigment and wherein the second colour substance comprises a second colour pigment.

6. The method as claimed in claim 2, wherein the core is a High Density Fibreboard board.

7. The method as claimed in claim 2, wherein the first colour substance comprises colour pigments and wood fibres.

8. The method as claimed in claim 3, wherein the first colour substance comprises colour pigments and wood fibres.

9. The method as claimed in claim 1, wherein the portion of the first powder mix is displaced from an original position by using a mechanical tool.

10. The method as claimed in claim 9, wherein the tool is a needle.

11. The method as claimed in claim 1, wherein the portion of the first powder mix is displaced from an original position by using a vacuum to remove powder.

12. The method as claimed in claim 1, wherein the portion of the first powder mix is displaced from an original position by adding first powder mix in a manner to displace second powder mix.

13. The method as claimed in claim 1, the method further comprising, after curing, treating the surface with a laser to create a design effect.

14. The method as claimed in claim 1, the method further comprising, after curing, treating the surface with a steel brush in order to remove softer material surface.

15. The method as claimed in claim 1, the curing step comprising using a structured press plate that is coordinated with a pattern created by the displacement of powder between the layers.

16. The method as claimed in claim 1, wherein the displacement forms a mixture of the first and second powder mixes.

* * * * *